US006478658B1

(12) United States Patent
Logan

(10) Patent No.: US 6,478,658 B1
(45) Date of Patent: Nov. 12, 2002

(54) APPARATUS FOR GENERATING LENS SURFACES

(75) Inventor: David J. Logan, Monterey, MA (US)

(73) Assignee: Gerber Coburn Optical, Inc., South Windsor, CT (US)

( * ) Notice: Subject to any disclaimer, the term of this patent is extended or adjusted under 35 U.S.C. 154(b) by 8 days.

(21) Appl. No.: 09/624,848

(22) Filed: Jul. 25, 2000

(51) Int. Cl.[7] ..... B24B 49/00; B24B 51/00

(52) U.S. Cl. ..... 451/5; 451/11; 451/69; 451/256; 451/332

(58) Field of Search ..... 451/5, 8, 9, 10, 451/11, 42, 69, 70, 178, 180, 211, 247, 255, 256, 332, 362, 390, 398

(56) References Cited

U.S. PATENT DOCUMENTS 4,038,783 A * 8/1977 Rosenthal ..... 451/123
4,829,716 A * 5/1989 Ueda et al. ..... 451/277
4,989,316 A 2/1991 Logan et al.
5,107,628 A 4/1992 Kondo et al.
5,748,482 A 5/1998 Nishimura
5,951,376 A * 9/1999 Mandler ..... 451/178

FOREIGN PATENT DOCUMENTS

JP 04025366 5/1990
JP 03294163 12/1991

* cited by examiner

*Primary Examiner*—Timothy V. Eley
(74) *Attorney, Agent, or Firm*—McCormick, Paulding & Huber LLP

(57) ABSTRACT

An apparatus for simultaneously machining a plurality of lens blanks to provide a lens surface on each blank corresponding to a selected lens prescription includes a tool support assembly and a lens blank assembly. The tool support assembly movably supports at least one tool. The lens blank support assembly includes a plurality of lens blank retainers for supporting a plurality of lens blanks. The tool support assembly and the lens support assembly move relative to each other such that the tool alternatingly engages each of the plurality of lens blanks for machining an individual lens prescription in a raster-like manner on each of the plurality of lens blanks.

15 Claims, 6 Drawing Sheets

APPARATUS FOR GENERATING LENS SURFACES

FIELD OF THE INVENTION

The present invention relates to devices for machining eyeglass lenses and, more particularly, to an apparatus for generating lens surfaces on a plurality of lens blanks in a single operation, whereby a cutting tool traverses the lens surface of each lens blank in a raster-like pattern according to one or more lens prescriptions.

BACKGROUND OF THE INVENTION

A common procedure used to make a lens for a pair of prescription eyeglasses employs a lens blank of glass or plastic having two major lens surfaces. Generally, one of the major surfaces is pre-finished and the other surface requires cutting and polishing operations performed on it to satisfy a given lens prescription for a particular eyeglass wearer. The lens blank is usually mounted in a lens surface generating apparatus that incorporates a cutting tool for engaging the major surface of the lens blank to be cut and polished. The cutting tool is typically moved along multiple axes in response to commands issued from a controller in accordance with data representing the prescription for the lens.

The cutting tool used to generate the convex or concave contours of the lens surface typically has a spherical cutting end or tip that rotates as it moves over the surface of the lens blank. This type of cutting tool is commonly referred to as a ball mill. During a lens surface generating operation, the ball mill is typically moved over the surface of the lens blank in a spiral pattern, beginning at the periphery of the lens blank and culminating at the blank's center. Lathe-type devices with a single point tool are also known.

One problem associated with the spiral machining is that the center of the lens includes an abnormality that requires a secondary operation to remove the abnormality.

Another difficulty encountered with generating a lens surface in this manner is that known lens surface generating apparatus generally accommodate a single lens blank, making the process for generating more than one lens time consuming and expensive.

Based on the foregoing, it is desirable to provide a lens surface generating apparatus that overcomes the above-described drawbacks of the prior art.

SUMMARY OF THE INVENTION

It is an object of the present invention to provide an improved apparatus and method for generating a lens surface.

It is another object of the present invention to provide a lens surface generating apparatus that can generate multiple lenses in a single operation each according to a different prescription.

According to the present invention, an apparatus for simultaneously machining a plurality of lens blanks to provide a lens surface on each blank corresponding to a selected lens prescription includes a tool support assembly and a lens blank assembly. The tool support assembly movably supports at least one tool. The lens blank support assembly includes a plurality of lens blank retainers for supporting a plurality of lens blanks. The tool support assembly and the lens support assembly move relative to each other such that the tool alternatingly engages each of the plurality of lens blanks for machining an individual lens prescription in a raster-like manner on each of the plurality of lens blanks.

In the preferred embodiment of the present invention, the tool support assembly includes a cutting tool rotatable about an axis substantially parallel to a Z-axis and movable in an X-axis direction in accordance with the individual lens prescription for each lens blank. The lens support assembly includes a flywheel with a plurality of lens blanks secured thereto. The flywheel is movable in the Z-axis direction and rotatable about Z-axis such that the cutting tool engages each lens blank individually for machining proper prescription thereon.

According to a feature of the present invention, a finishing tool is also supported by the tool support assembly to finish the polishing of each of the lens blanks.

According to another embodiment of the present invention, at least one tool is disposed on a flywheel that is rotatable about a Z-axis and movable in the Z-axis direction and a plurality of lens blanks are supported by a frame. Each lens blank is movable by an actuator in an X-axis direction in accordance with the individual lens prescription into engagement with the tool for machining proper prescription onto each of the lenses.

The apparatus of the present invention allowing raster-like machining of multiple lenses results in a lens that does not include a central abnormality, thereby yielding a better final product.

One advantage of the present invention is that multiple lenses are generated simultaneously with each lens blank being machined according to its individual prescription.

The foregoing and other advantages of the present invention become more apparent in light of the following detailed description of the exemplary embodiments thereof, as illustrated in the accompanying drawings.

DETAILED DESCRIPTION OF THE INVENTION

Figure 1:
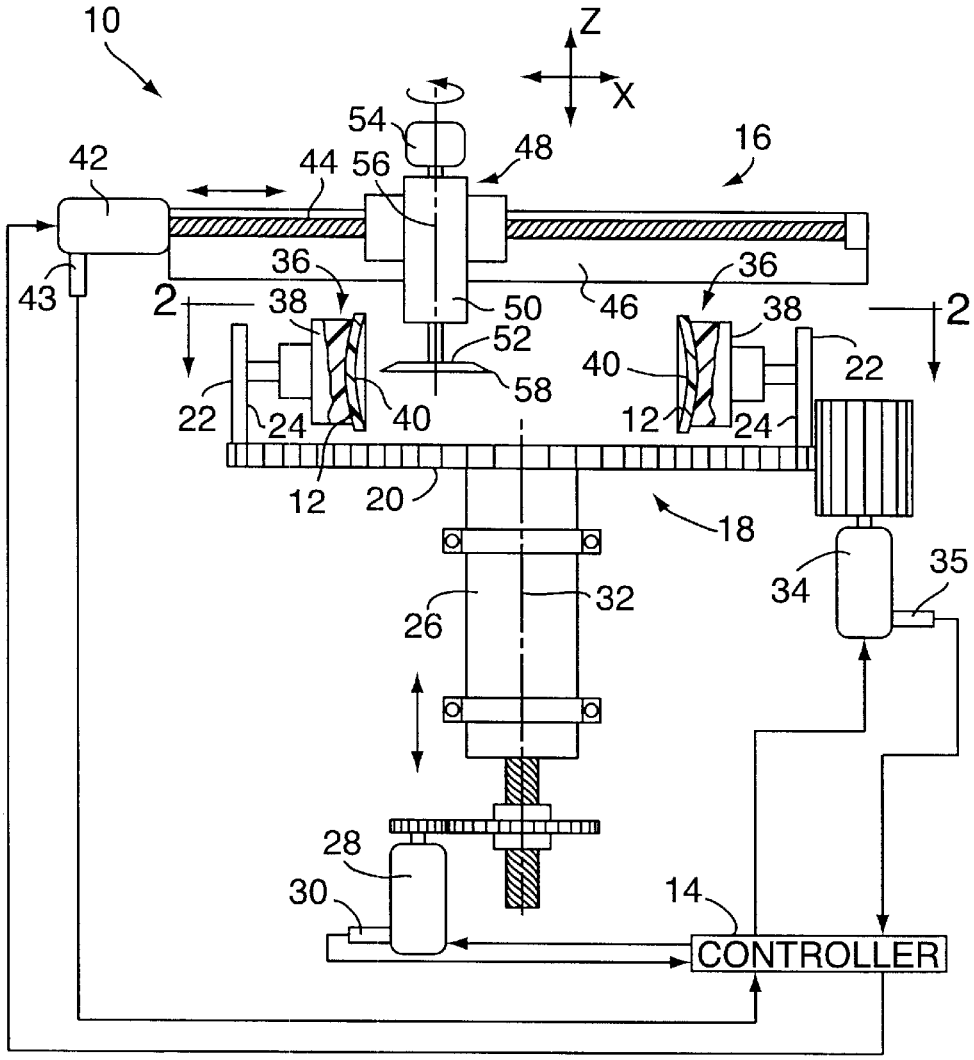
FIG. 1 is a schematic side view of the apparatus for generating lens surfaces on a plurality of lens blanks with a tool, according to the present invention.

Referring to FIG. 1, an apparatus 10 for simultaneously machining a plurality of lens blanks 12 includes a controller 14 for storing data representing one or more lens prescriptions. The apparatus 10 also includes a tool support assembly 16 and a lens support assembly 18. The lens support assembly 18 includes a flywheel 20 having a side portion 22 with a support surface 24. The flywheel 20 is supported by a translating shaft 26 and driven in a Z-axis direction by a Z-drive motor 28. A Z-drive encoder 30 is connected to the motor 28 and communicates with the controller 14. The flywheel 20 is rotated about an axis 32 by a flywheel rotary motor 34. A rotary encoder 35 is connected to the motor 34 and communicates with the controller 14.

Figure 2:
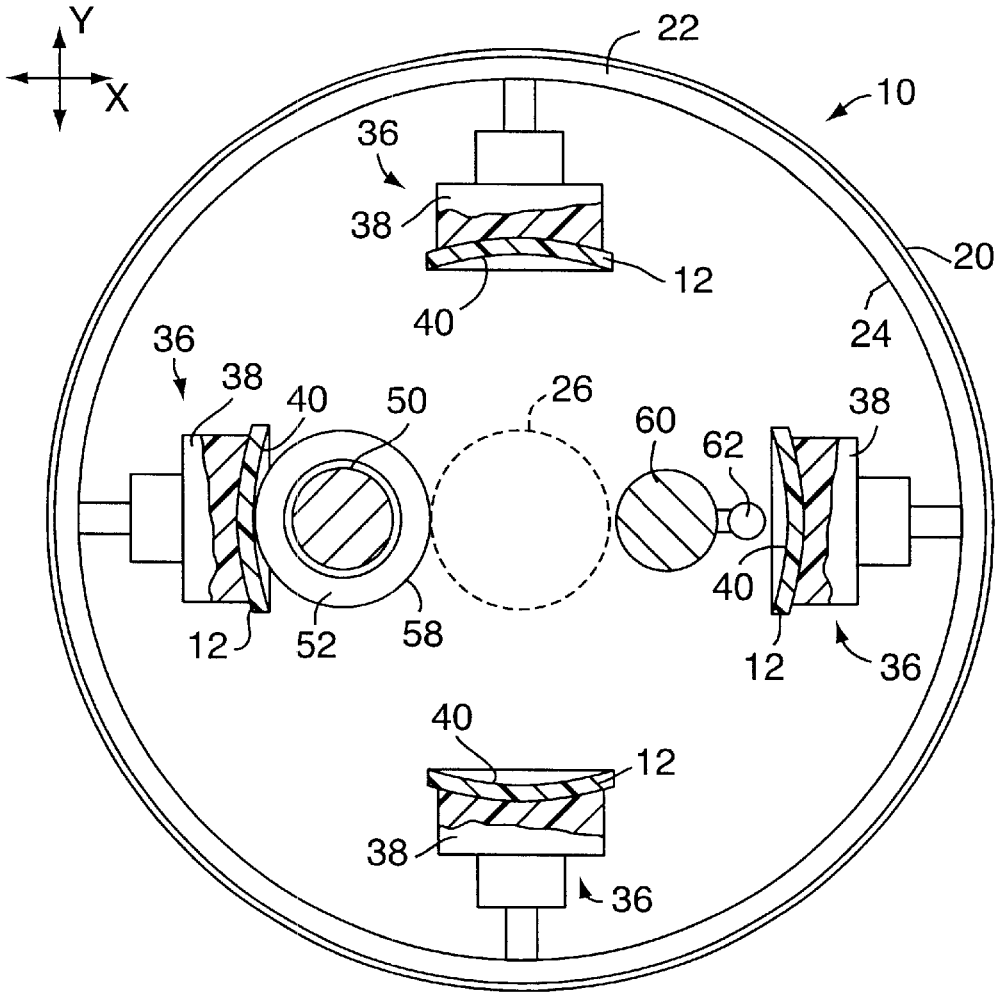
FIG. 2 is a plan view, taken along line 2—2, of the apparatus of FIG. 1.

Referring to FIG. 2, a plurality of lens blank retainers 36 is fixedly attached to the support surface 24 of the side portion 22 of the flywheel 20. Each lens blank retainer 36 includes a chuck 38 for holding the lens blank 12. Each lens blank 12 includes a lens surface 40. Although four lenses are shown to be simultaneously machined, any other number of lenses can be placed around the flywheel 20.

The tool support assembly 16 includes a tool actuator motor 42 with an encoder 43 driving a lead screw 44 secured to a fixed beam 46, as best seen in FIG. 1. A cutting tool 48 is movably secured to the lead screw 44. The cutting tool 48 includes a cutting tool spindle 50 and a cutter 52. The cutting tool spindle 50 includes a cutting rotary motor 54 for rotating the cutter 52 about an axis 56. In the preferred embodiment of the present invention, the cutter 52 is a milling saw having a cutting edge 58. The cutting edge 58 is formed to have a predetermined radius. However, the cutter 52 can be replaced with a diamond ball.

In operation, each of the plurality of lens blanks 12 is secured to the corresponding lens retainer 36. An individual prescription for each of the plurality of lenses is loaded into the controller 14. The flywheel 20 is uniformly moved in the Z-axis direction by the Z-drive motor 28 and is uniformly rotated about its axis 32 by the flywheel rotary motor 34. As the flywheel 20 is rotated, each of the lens blanks 12 is sequentially engaged by the cutting tool 48.

Figure 3:
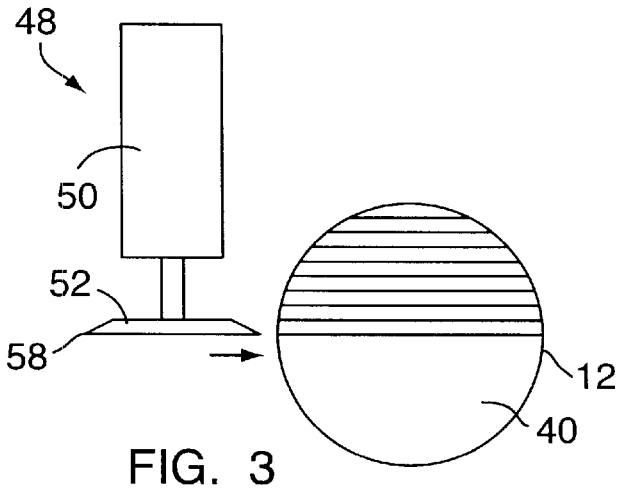
FIG. 3 is an enlarged, schematic front view of the lens blank being machined by the tool of FIG. 1.

As the cutting edge 58 of the cutter 52 of the cutting tool 48 engages surface 40 of one of the lens blanks 12, the cutter 52 makes a single pass therethrough, as shown in FIG. 3. Therefore, the tool support assembly 16 and the lens support assembly 18 have a rotational and a linear component of movement relative to each other, the linear component being along a direction generally across a face of each respective lens blank 12, such that the cutting tool 48 alternatingly engages each of the plurality of lens blanks. The extent of the cutting engagement between the cutter 52 and the lens blank 12 is governed by the specific prescription of that particular lens 12 stored in the controller 14. The controller 14 directs the amount of X-axis engagement of the cutting tool 48 for each rotational position of the flywheel 20.

The flywheel 20 is substantially uniformly rotated until the cutting tool 48 completes the machining pass through the lens 12. With the flywheel 20 continuing to rotate, the cutting tool 48 engages the following lens blank 12. The extent of engagement between the cutting tool 48 and each of the lens blanks 12 depends on the specific prescription therefor. For each revolution of the flywheel 20, the flywheel 20 moves the thickness of the cutter 52 in the Z-axis direction. Encoders 30, 35 and 43 provide feedback information to the controller 14 regarding the position of motors 28, 34 and 42, respectively.

Figure 4:
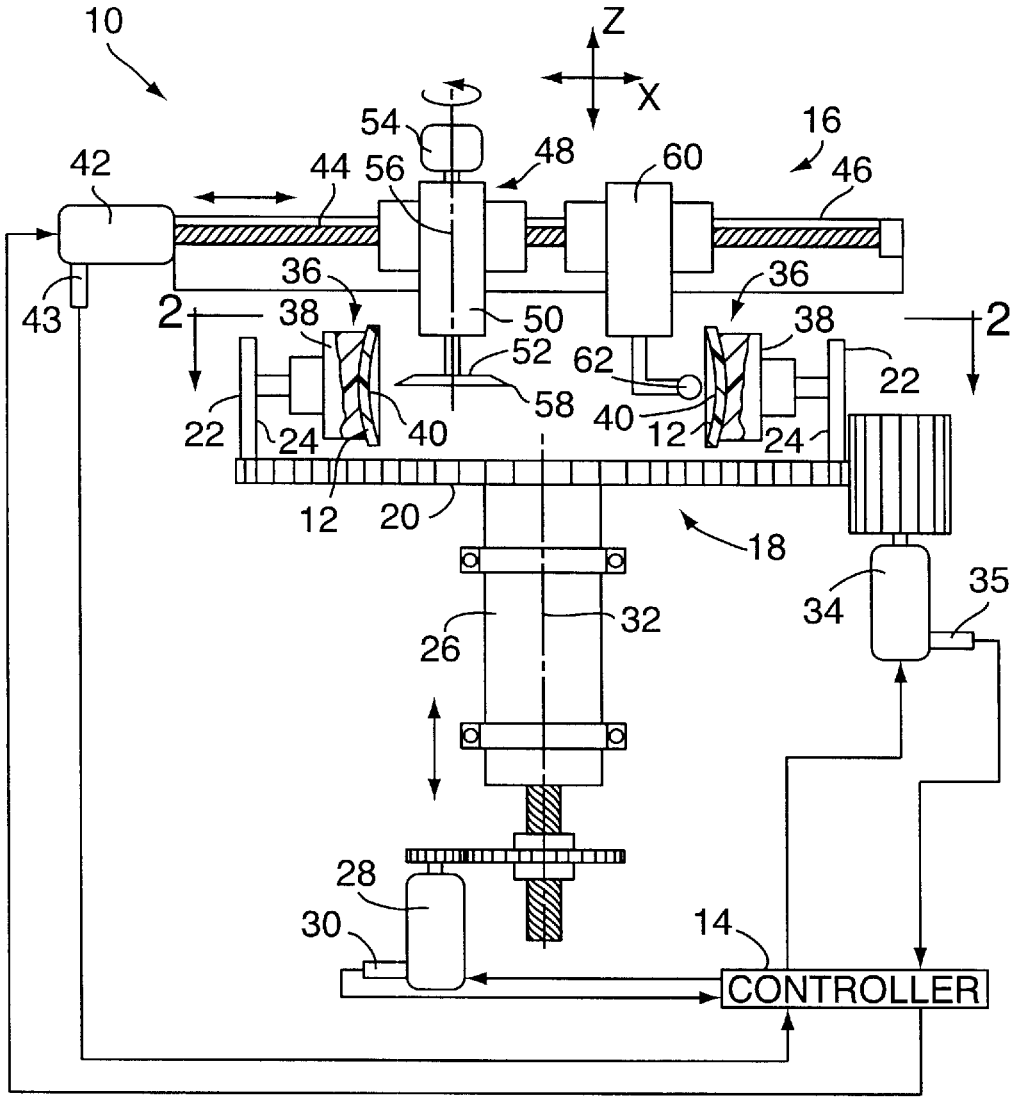
FIG. 4 is a schematic side view of the apparatus for generating lens surfaces on a plurality of lens blanks according to another embodiment of the present invention.

Referring to FIG. 4, according to another embodiment of the present invention, the tool support assembly 16 also includes a finishing tool holder 60 having a finishing tool 62. In the preferred embodiment of the present invention, the finishing tool is a diamond. The finishing tool holder 60 is secured onto the beam 46 to be movable in the X-axis direction along the lead screw 44.

Once all of the excess material has been removed from the lens blanks by the cutting tool 48, the finishing tool 60 engages each of the lens blanks 12 sequentially to finish each lens. The finishing tool 60 moves in the X-axis direction to engage each lens as the flywheel 20 is rotated.

The apparatus 10 of the present invention that machines a plurality of lenses simultaneously in a raster-like fashion, eliminates the need for additional polishing of each lens. In contrast to the equipment that machine the lens in a spiral fashion and result in a central blemish on the lens, the apparatus 10, according to the present invention, eliminates the central abnormality. Depending on the particular application and specific type of the cutting tool used, the lens can be cut by the cutting tool only and then finished by other equipment well known in the industry. Alternatively, with use of the cutting tool 48 and the finishing tool 62, as shown in FIG. 4, the lens can be ready for polymer hardcoating without requiring additional finishing and polishing steps.

Figure 5:
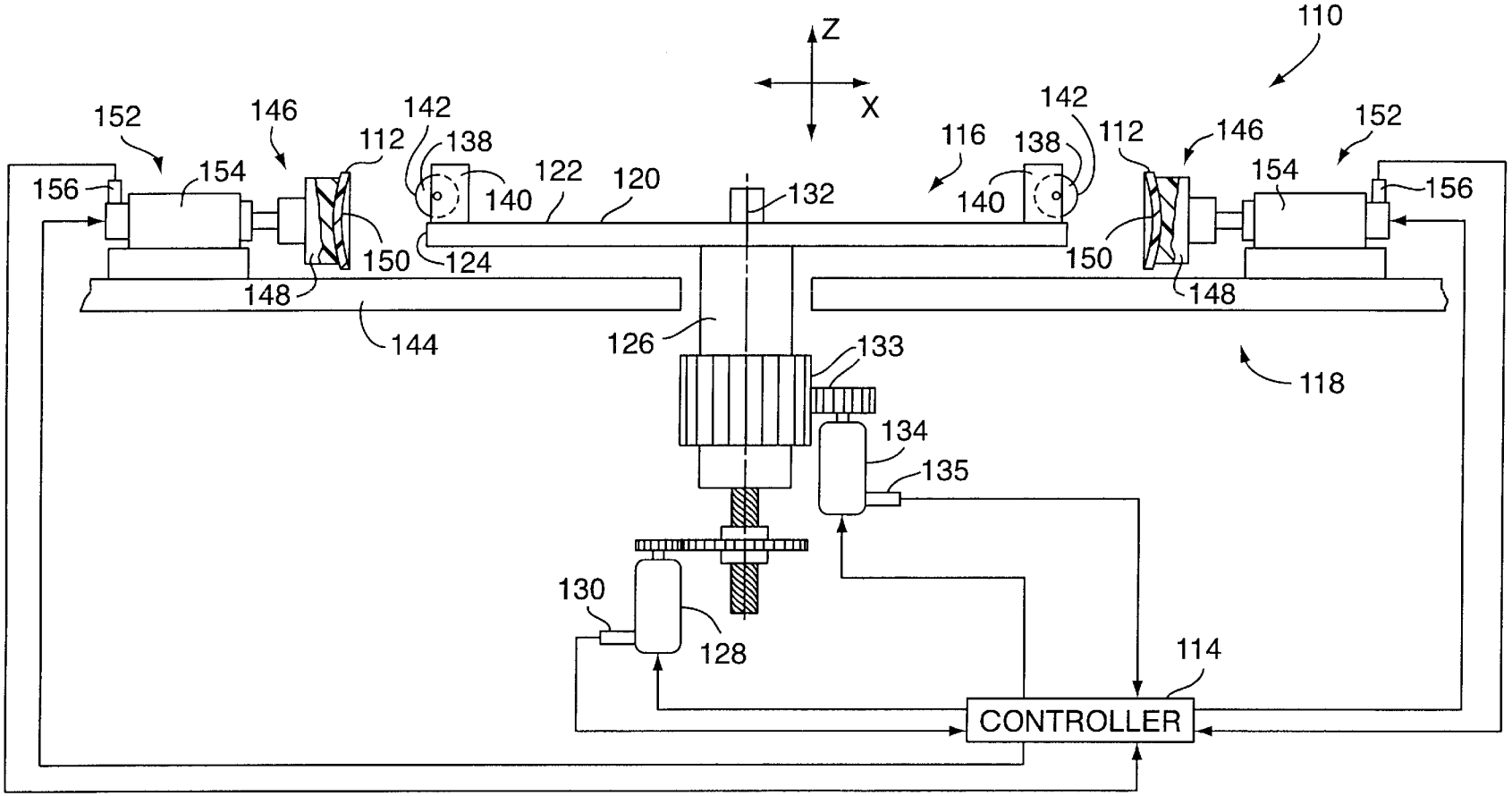
FIG. 5 is a schematic side view of the apparatus for generating lens surfaces on a plurality of lens blanks according to a further embodiment of the present invention.
Figure 6:
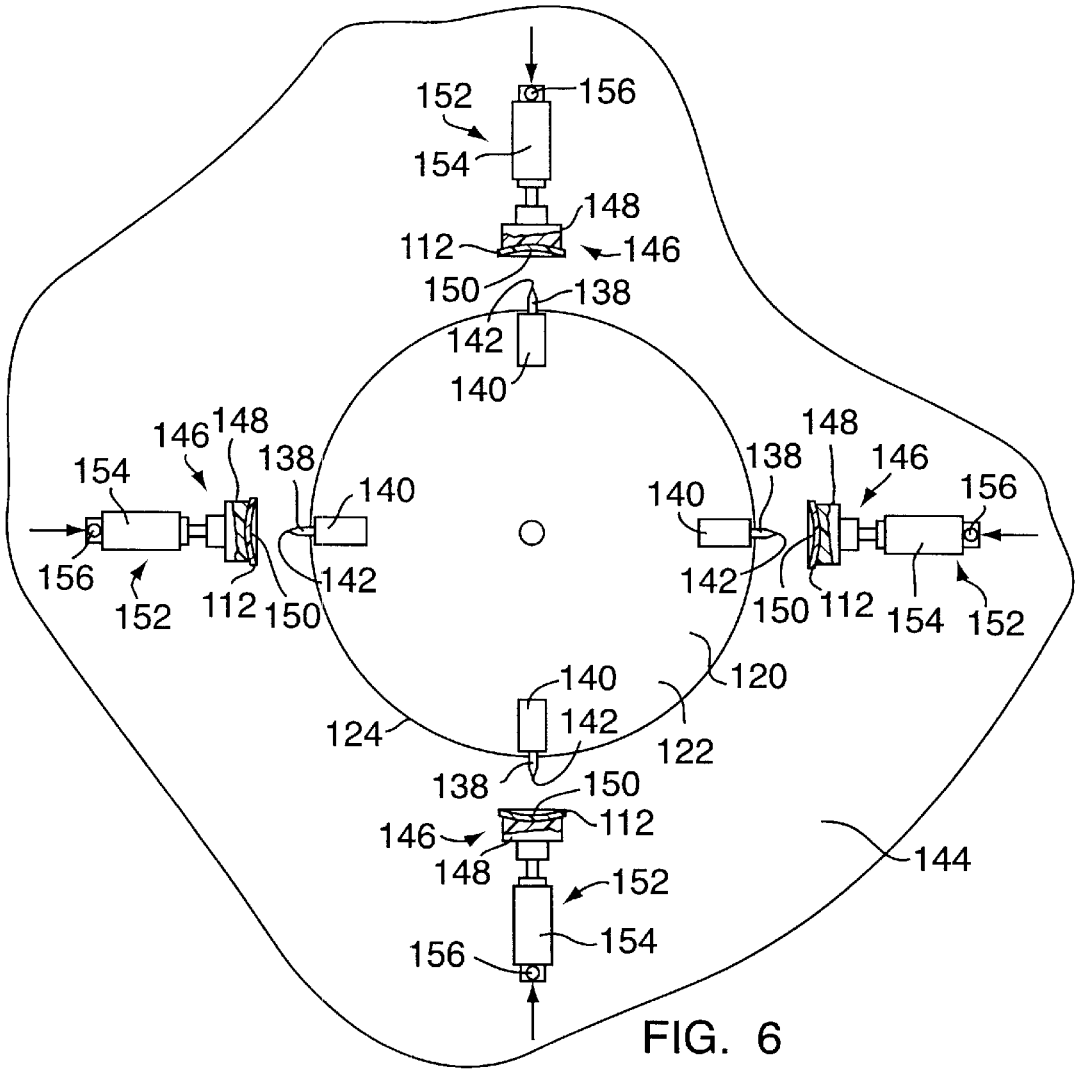
FIG. 6 is a top view of the apparatus illustrated in FIG. 5.
Figure 7A:
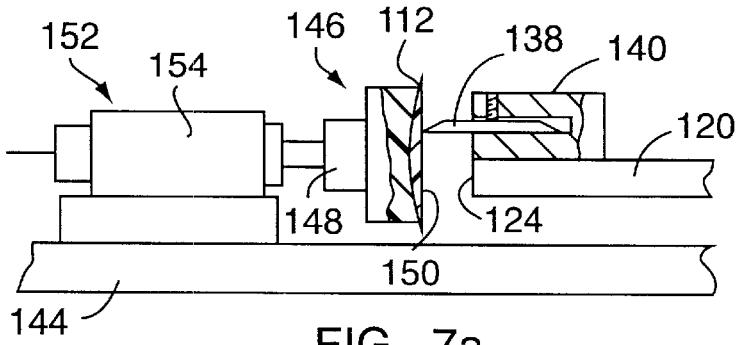
FIGS. 7*a–d* are partial side elevational views showing each of the plurality of cutting tools of the apparatus of FIG. 5 simultaneously performing a cutting operation on the plurality of lens blanks in accordance with each individual lens prescription.
Figure 7B:
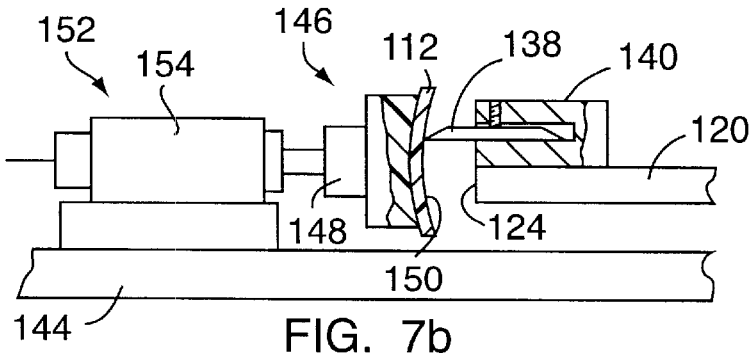
Figure 7C:
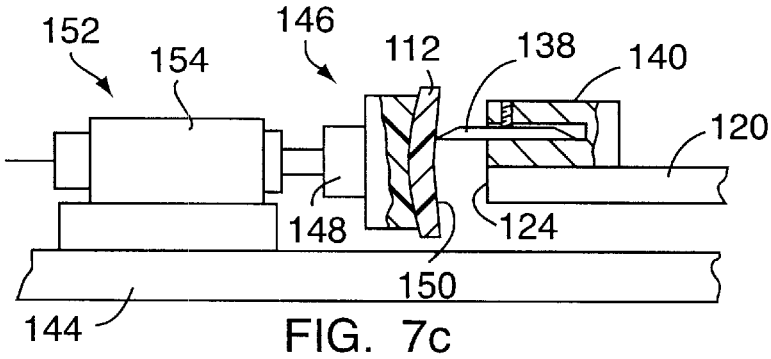
Figure 7D:
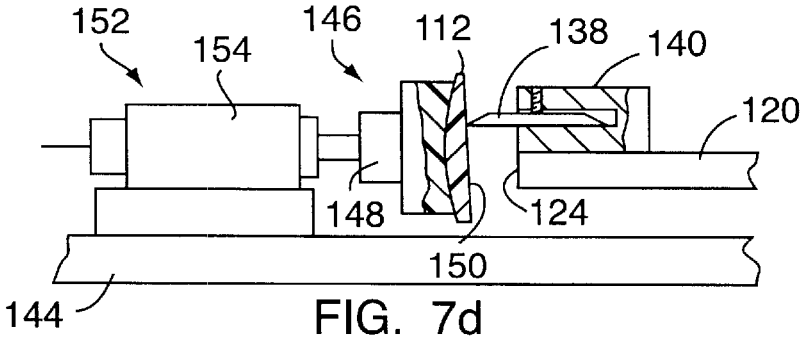

FIGS. 5 and 6 illustrate an apparatus 110 according to another embodiment of the present invention for simultaneously machining a plurality of lens blanks 112. The apparatus 110 includes a controller 114 which stores data representing one or more lens prescriptions. The controller 114 issues command signals in machine-readable format to various components of the apparatus in accordance with the data to control the overall machining operation of the apparatus. The apparatus 110 further includes a tool support assembly 116 and a lens support assembly 118. The tool support assembly 116 includes a flywheel 120 having a support surface 122 and a peripheral edge portion 124. The flywheel 120 is mounted on a shaft 126 and is driven in a Z-axis direction by a Z-drive motor 128 between a raised and a lowered position in response to command signals issued by the controller 114. An encoder 130 is in communication with the motor 128 and issues signals to the controller 114 during operation indicating the position of the shaft 126 and thereby the flywheel 120. Thus, the controller 114 precisely controls the movement of the flywheel 120 between the raised and lowered positions during the machining operation. The flywheel 120 is rotated about its central axis 132 through a plurality of gears 133 by a flywheel rotary motor 134. An associated encoder 135 is connected to the rotary motor 134 and issues signals to the controller 114 indicating rotational position of the flywheel 120.

A plurality of cutting bits 138 are releasably mounted in a plurality of associated bit retainers 140 supported on the support surface 122 of the flywheel 120 adjacent to the peripheral edge portion 124. The bit retainers 140 are spaced around the support surface 122, with at least a cutting edge 142 of each cutting bit 138 extending beyond the peripheral edge portion 124 of the flywheel 120.

The lens support assembly 118 includes a fixed frame 144 with a plurality of lens blank retainers 146 mounted in spaced relationship on the frame 144 adjacent to the peripheral edge portion 124 of the flywheel 120. Each lens blank retainer 146 includes a chuck 148 for holding the lens blank 112 defining at least one outwardly facing lens surface 150. Each lens blank retainer 146 also includes an X-axis actuator 152 for moving the lens blank 112 in an X-axis direction oriented approximately orthogonal to the central axis 132 between a forward and rearward position. The movement of each actuator 152 is independently controlled in response to commands issued from the controller 114. When the controller 114 directs a particular actuator 152 to move its associated lens blank into the forward position, the lens surface 150 of the blank 112 is placed in cutting engagement with the cutting edges 142 of the cutting bits 138. In the preferred embodiment, the X-axis actuator 152 includes a servo-motor 154 connected to an associated encoder 156.

In operation, in accordance with the lens prescription data, the controller 114 issues command signals to cause the drive motor 134 to rotate the flywheel 120 about the central axis 132 at a predetermined rate of rotation. Simultaneously, and also in response to commands issued by the controller 114, the actuator 128 moves the flywheel 120 in the Z-axis direction between the raised and lowered positions. The controller 114 also independently actuates each lens motor 154 to move the lens surface 150 of each of the lens blank 112 into cutting engagement with the cutting surface 142 of each cutting bit 138. The relatively high rotational inertia of the flywheel 120 permits smooth constant speed motion as the cutting bits 138 engage the lens blanks 112 and perform the machining operation, and the simultaneous rotation of the flywheel 120, the movement of the flywheel in the Z-axis direction, and the independent movement of each lens blank 112 in the X-axis direction causes the cutting bits 138 to engage and traverse the lens surface 150 of each lens blank 112 in a raster-like pattern. The raster-like pattern cutting performed by the apparatus 110 provides a superior finish free of the scalloped indentations, tool marks and center flaws that are characteristic of prior art lens turning machines.

Although FIGS. 5 and 6 show a plurality of bit retainers 140 with cutting bits 138, one or more bit retainers with cutting bits would be acceptable. Similarly, although four lenses are shown in FIGS. 5 and 6, any number of lenses can be fabricated simultaneously according to the present invention.

As shown in FIGS. 7*a–d,* the independent movement of each lens blank retainer 146 allows each of the lens blanks 112 to be cut according to a different lens prescription in response to commands issued from the controller 114. This is accomplished by repositioning each lens blank retainer 146 in the X-axis direction as the rotating flywheel 120 brings successive cutting tools into engagement with the block held by the retainer. Thus, the lens surface 150 of each blank 112 can be independently machined to provide the values of sphere, cylinder, axis, prism or other optical parameters specified by a particular lens prescription. For example, the data for the lens illustrated in FIG. 7*a* corresponds to a prescription requiring a plus spherical lens, while the data for the lens shown in FIG. 7*b* corresponds to a prescription specifying a minus spherical lens. The data for the lens shown in FIG. 7*c* corresponds to a prescription requiring a minus spherical lens with a base-up prismatic effect. The data for the lens shown in FIG. 7*d* corresponds to a prescription requiring a plus spherical lens which is de-centered nasally so that thinnest edge of the lens is the temporal edge. Since the apparatus 110 is capable of simultaneously machining a plurality of lenses, the different lens prescriptions are generated in a single machining operation. Thus, the apparatus of the present invention provides significantly enhanced productivity as compared with prior art lens cutting devices.

Although in the preferred embodiment of the present invention, the motors and/or actuators are servo-motors, those skilled in the pertinent art will recognize that the motors and/or actuators are not limited to the illustrated servomotor and encoder combination, but can be any one of a number of known actuator types suitable for moving a load between a raised position and a lowered position and/or for rotating the flywheel. Other suitable actuators include, for example, a hydraulic or pneumatic piston/cylinder coupled to a servo-valve, or a lead screw threadably engaged with a collar that in turn is coupled for rotation to bracket. Additionally, stepper motors or air bearing motors can be substituted without departing from the broader aspects of the present invention.

While preferred embodiments have been shown and described, various modifications and substitutions may be made without departing from the spirit and scope of the present invention. Accordingly, it is to be understood that the present invention has been described by way of example, and not by limitation.

I claim:

1. An apparatus for simultaneously preparing a plurality of lens blanks, each of said lens blanks having a first major surface, said apparatus comprising:

a tool support assembly for movably supporting at least one tool; and a lens support assembly for supporting said plurality of lens blanks, wherein said tool support assembly and said lens support assembly have a rotational and a linear component of movement relative to each other, the linear component being along a direction generally across a face of each respective lens blank, such that said at least one tool alternatingly engages each of said plurality of lens blanks for machining an individual lens prescription in a raster-like manner on each of said plurality of lens blanks.

2. The apparatus according to claim 1 wherein said tool support assembly further comprises:

a first actuator for moving said tool relative to each of said lens blanks in an X-direction in accordance with said individual lens prescription; and a second actuator for rotating said tool about its central axis for machining extraneous material from a lens blank.

3. The apparatus according to claim 2 wherein said tool support assembly further comprises:

a finishing tool for engaging each of said plurality of lens blanks for finishing said major surfaces thereof.

4. The apparatus according to claim 3 wherein said finishing tool includes a workpiece.

5. The apparatus according to claim 4 wherein said workpiece is a diamond.

6. The apparatus according to claim 1 wherein said tool is a cutting tool comprising a cutting workpiece.

7. The apparatus according to claim 6 wherein said cutting workpiece is a saw.

8. The apparatus according to claim 6 wherein said cutting workpiece is a diamond.

9. The apparatus according to claim 1 wherein said lens support assembly further comprises:

a flywheel for fixedly supporting said plurality of lens blanks;

a Z-axis drive for moving said flywheel in Z-axis direction; and a rotary drive for rotating said flywheel about its central axis for each of said plurality of lens blanks to alternatingly engage said cutting tool.

10. The apparatus according to claim 1 further comprising:

a controller for storing prescription data for each of said plurality of lenses and for controlling said lens support assembly and said tool support assembly.

11. The apparatus according to claim 1 wherein said tool support assembly further comprises:

a flywheel with a plurality of tools mounted thereon;

a rotary drive for rotating said flywheel about its axis; and a Z-drive for moving said flywheel in a Z-axis direction.

12. The apparatus according to claim 1 wherein said lens support assembly further includes:

a plurality of lens supports fixedly attached on a frame for supporting said plurality of lens blanks.

13. An apparatus for simultaneously preparing a plurality of lens blanks, each of said lens blanks having a first major surface, said apparatus comprising:

a tool support assembly for movably supporting at least one tool, said tool being movable in an X-axis direction and rotatable about its axis;

a lens support assembly including a flywheel for supporting said plurality of lens blanks, said flywheel being movable in a Z-axis direction and rotatable about its central axis for each of said plurality of lens blanks to alternatingly engage said cutting tool, wherein said tool support assembly and said lens support assembly have a rotational and a linear component of movement relative to each other such that said at least one tool alternatingly engages each of said plurality of lens blanks for machining an individual lens prescription in a raster-like manner on each of said plurality of lens blanks; and a controller for storing prescription data for each of said plurality of lenses and for controlling said lens support assembly and said tool support assembly.

14. An apparatus for simultaneously machining a plurality of lens blanks to provide a major lens surface on each one of the blanks corresponding to a selected lens prescription, said apparatus comprising:

a controller for storing data representing one or more lens prescriptions and for issuing command signals in machine readable format in accordance with the data;

a tool support having a support surface, a peripheral edge portion, and a central axis;

at least one cutting tool mounted on the support surface adjacent to the peripheral edge portion of the tool support;

a rotational drive for rotating the tool support about the central axis in response to command signals issued by the controller;

a Z-axis drive for moving the tool support in a Z-axis direction between a raised and a lowered position in response to command signals issued from the controller;

a plurality of lens blank retainers for releasably supporting one of the plurality of lens blanks; and an X-axis drive associated with each one of the lens blank retainers for selectively moving each retainer in an X-axis direction oriented approximately orthogonal to the central axis between a forward and rearward position in response to command signals issued by the controller, said controller directing the rotational movement of the tool support, the movement of the tool support in the Z-axis direction, and the movement of each lens blank retainer in the X-axis direction to cause the cutting tools to engage and traverse the major lens surface of each lens blank in a raster-like pattern and thereby simultaneously machine the plurality of lens blanks in accordance with data representing at least one of the lens prescriptions stored in the controller.

15. The apparatus of claim 14, wherein the tool support comprises a flywheel having an upper surface defining the support surface.

* * * * *